US006575793B1

(12) United States Patent
Li et al.

(10) Patent No.: US 6,575,793 B1
(45) Date of Patent: Jun. 10, 2003

(54) AUDIO JACK CONNECTOR

(75) Inventors: Chun Sheng Li, Kunsan (CN); GuangXing Shi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/175,963

(22) Filed: Jun. 19, 2002

(30) Foreign Application Priority Data

Dec. 26, 2001 (TW) ..... 90222985 U

(51) Int. Cl.[7] ..... H01R 24/04
(52) U.S. Cl. ..... 439/668; 439/188; 439/669
(58) Field of Search ..... 439/668, 669, 439/188, 108

(56) References Cited

U.S. PATENT DOCUMENTS 6,077,126 A * 6/2000 Peng ..... 439/668
6,220,899 B1 * 4/2001 Suzuki ..... 439/669
6,270,380 B1 * 8/2001 Shichida et al. ..... 439/669
6,312,274 B1 * 11/2001 Lin ..... 439/668
2002/0052148 A1 * 5/2002 Nagata ..... 439/668

* cited by examiner

*Primary Examiner*—Tho D. Ta
(74) *Attorney, Agent, or Firm*—Wei Te Chung

(57) ABSTRACT

An audio jack connector includes an insulating body (6) and a plurality of terminals retained therein. The insulating body comprises a front wall (68), a top wall (69), a bottom wall (61), a pair of side walls (62, 63), and a rear face (64) opposite to the front wall. A receiving space (601) is defined through the insulating body from the rear face to a projecting portion (65). The bottom wall defines a first slit (604) in communication with the receiving space. The top and bottom walls together define a plurality of slits (605, 606, 607) from the rear face toward the front wall. A first terminal (1) is received in the first slit from the bottom wall and a plurality of terminals (2, 3, 4) are received in the plurality of slits defined in the insulating body from the rear face. The design of the body and terminals gives greater strength to the audio jack than certain jacks of the prior art had.

3 Claims, 5 Drawing Sheets

AUDIO JACK CONNECTOR

CROSS-REFERENCE TO RELATED APPLICATION

This patent application is a Application of patent application Ser. No. 10/041077, entitled "AUDIO JACK HAVING SIDE MOUNT GROUNDING TERMINAL", now U.S. Pat. No. 6,478,629, and Ser. No. 10/136497, entitled "SOCKET CONNECTOR HAVING ADDITIONAL RING" invented by the same inventors, assigned to the same assignee.

BACKGROUND OF THE INVENTION

1. Field of the Invention

The present invention relates to an audio jack connector, and particularly to an audio jack connector having a stronger housing.

2. Description of Related Art

U.S. Pat. No. 6,290,544 discloses a conventional audio jack connector. Referring to FIG. 5, the conventional audio jack connector comprises an insulative body 7 and six terminals retained in the body 7. Five slits (not shown) are defined through a rear face 71 and extend toward a front face 72 of the body 7 for receiving five of the six terminals therein. The six terminals comprise a first, second, and third resilient terminals 81, 83, 85, and a first, second, and third fixing terminals 82, 84, 86. Each terminal 81, 82, 83, 84 and 85 has an engaging portion (not labeled) inserted into a corresponding slit of the body 7 from the rear face 71 of the body 7.

The integrity of the body 7 of the conventional audio jack connector is adversely affected by the five slits defined in the body 7. Because the body 7 is weakened, the audio jack connector may be damaged when a large external force is exerted thereon. Furthermore, the terminals 81, 83, 84, and 85 each have a long length because they are inserted into the body 7 from the rear face 71 to the front face 72 and these require a relatively large mass of conductive material for their manufacture. Thus, an improved audio jack connector should be developed to solve the existing problem.

SUMMARY OF THE INVENTION

An object of the present invention is to provide an audio jack connector having a strong insulating body and a terminal having small dimension for being received therein.

In order to achieve the object set forth, an audio jack connector comprises an insulating body and a plurality of terminals received therein. The insulating body comprises a front wall, a top wall and a bottom wall extending rearwardly from top and bottom edges of the front wall, two side walls each extending perpendicular to the top, bottom and front walls, and a rear face opposite to the front wall. A receiving space is defined through the insulating body from the rear face to the front wall. The bottom wall defines a first slit in communication with the receiving space. The top and bottom walls together define a second, third and fourth slits from the rear face toward the front wall. A first terminal is received in the first slit through the bottom wall and a second, third and fourth terminals are received in second, third and fourth slits from the rear face. A fifth slit in a sidewall receives a fifth terminal.

Other objects, advantages and novel features of the invention will become more apparent from the following detailed description when taken in conjunction with the accompanying drawings.

DETAILED DESCRIPTION OF THE INVENTION

Figure 1:
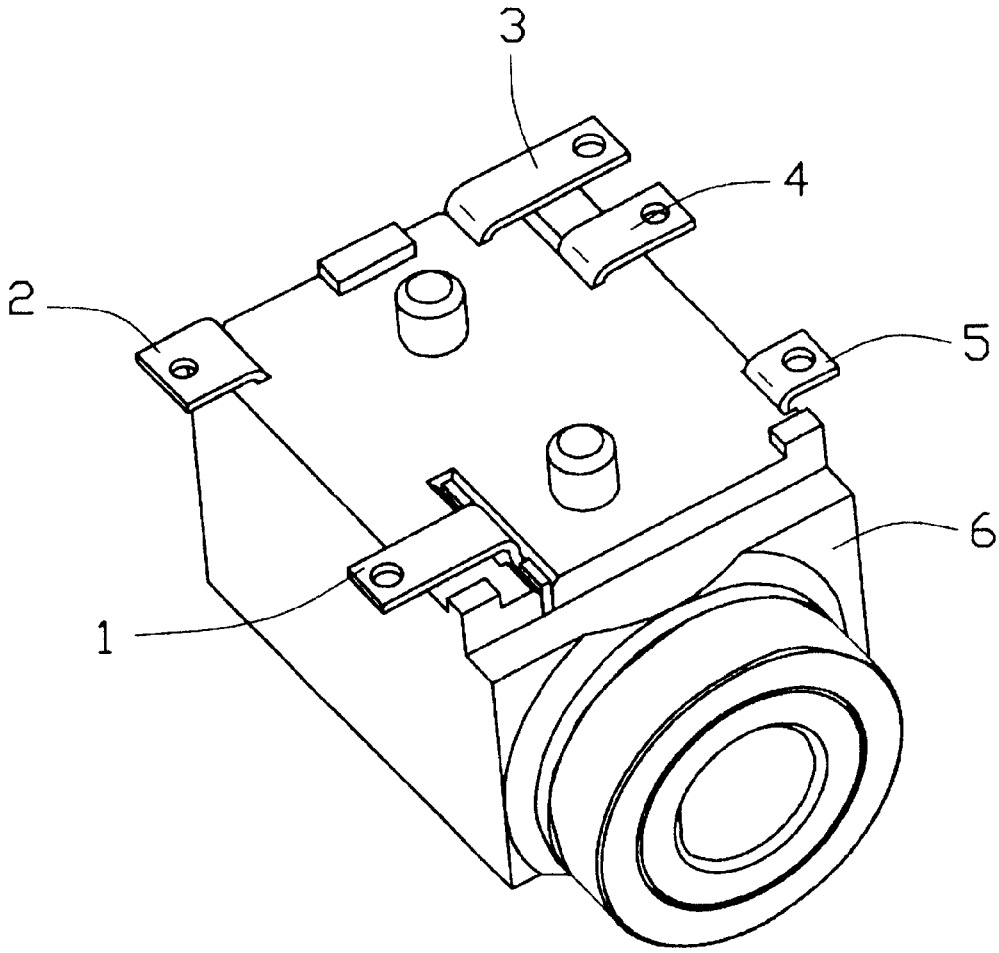
FIG. 1 is a perspective view of an audio jack connector in accordance with the present invention.

Reference will now be made to the drawing figures to describe the present invention in detail.

Figure 2:
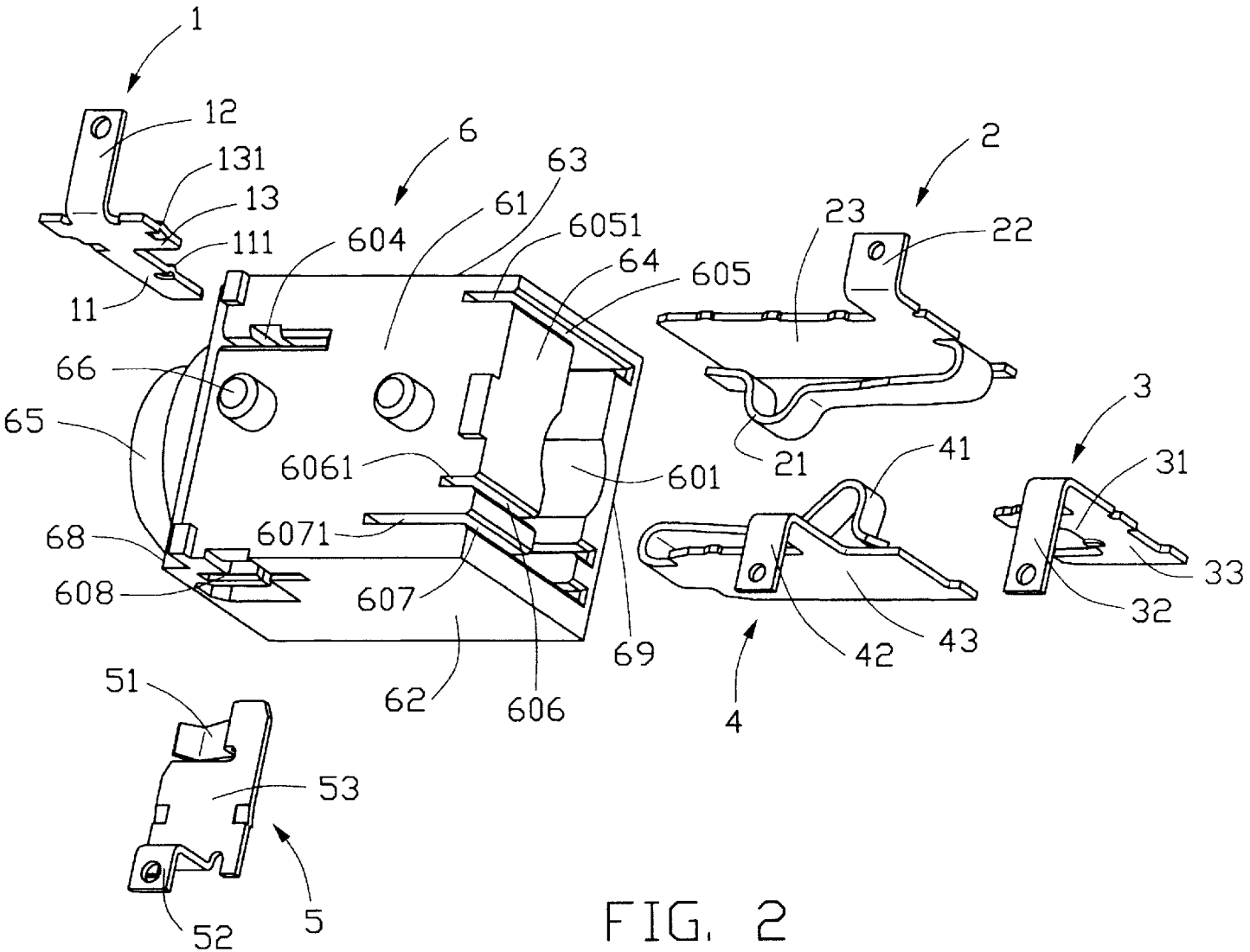
FIG. 2 is an exploded view of the audio jack connector shown in FIG. 1.

Referring to FIGS. 1 and 2, an audio jack connector in accordance with the present invention comprises an insulating body 6, a first and a second fixing terminals 1, 3, a first and a second resilient terminals 2, 4, and a grounding terminal 5.

The insulating body 6 comprises a front wall 68, a pair of side walls 62, 63 extending rearwardly from opposite sides of the front wall 68, and a top wall 69 and a bottom wall 61 extending rearwardly from top and bottom edges of the front wall 68 and perpendicularly to the side walls 62, 63. The front wall 68 has a tubular projection portion 65 extending forwardly therefrom. The insulating body 6 further has a rear face 64 opposite to the front wall 68. A receiving space 601 is defined through the insulating body 6 from the rear face 64 to and through the tubular projection 65 for receiving a mating plug 7 (shown in FIG. 4).

Referring to FIG. 2, the bottom wall 61 defines a first slit 604 in a longitudinal direction and adjacent to the front wall 68. The first slit 604 runs through the bottom wall 61 and is in communication with the receiving space 601. The bottom wall 61 and the top wall 69 together define a second slit 605, a third slit 606, and a fourth slit 607 from the rear face 64 toward the front wall 68. The second, the third and the fourth slits each have an opening 6051, 6061, 6071 extending through the bottom wall 61. The second, the third and the fourth slits 605, 606, 607 are in communication with the receiving space 601. A fifth slit 608 is defined in the side wall 62 and in communication with the receiving space 601. The bottom wall 61 of the body 6 forms a pair of positioning posts 66 receivable in holes defined in a printed circuit board (PCB) for positioning purpose.

Figure 3:
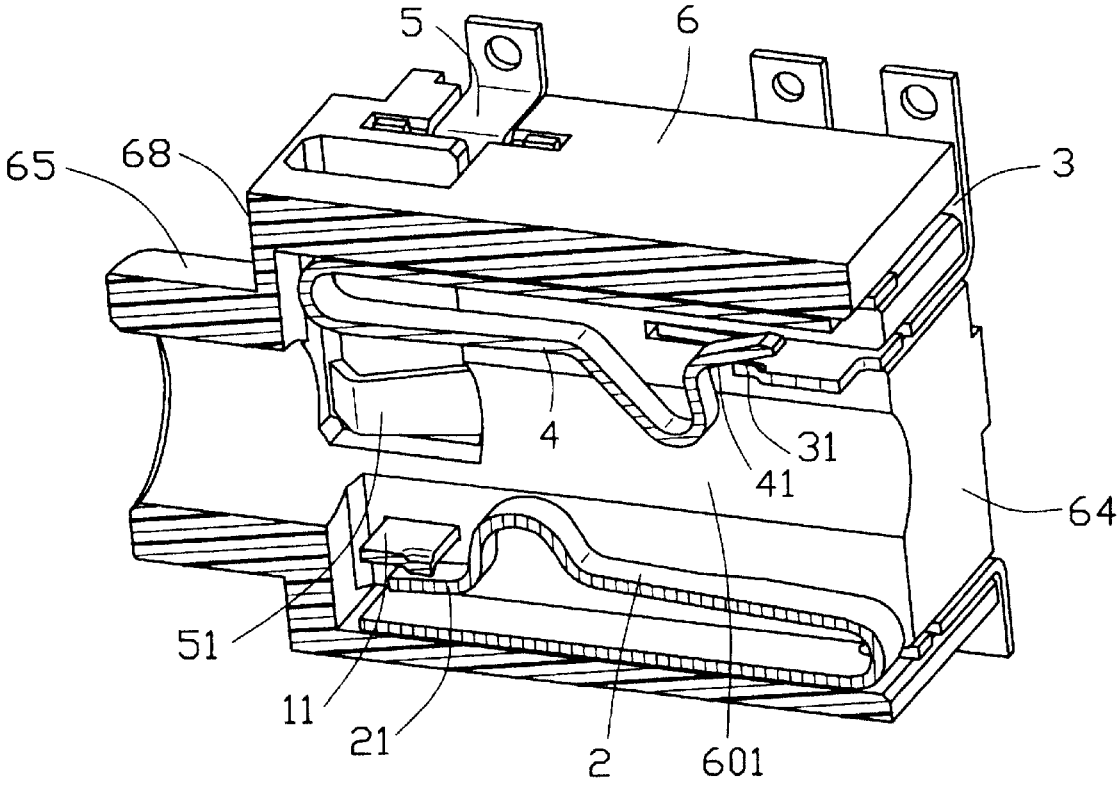
FIG. 3 is a cross-sectional view of the audio jack connector shown in FIG. 1.
Figure 4:
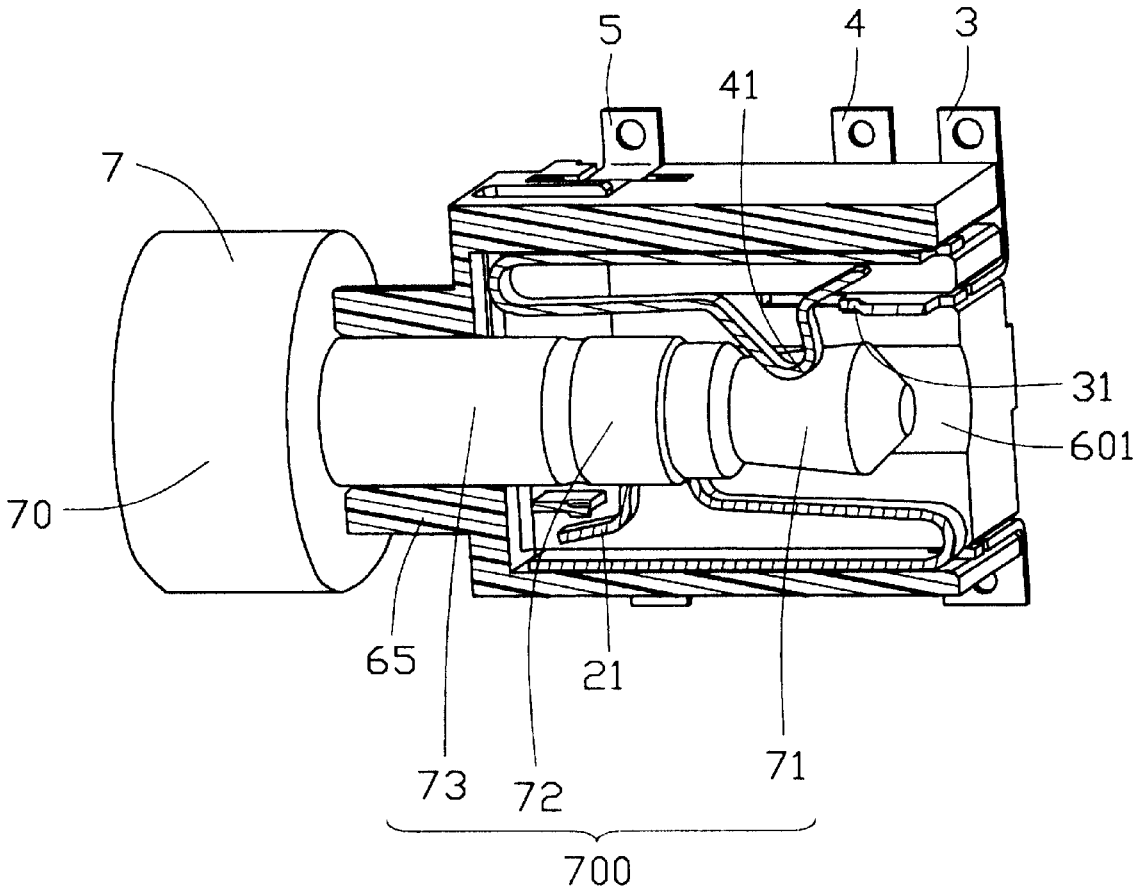
FIG. 4 is a cross-sectional view of the audio jack connector of FIG. 1 with a plug inserted into a receiving space thereof.
Figure 5:
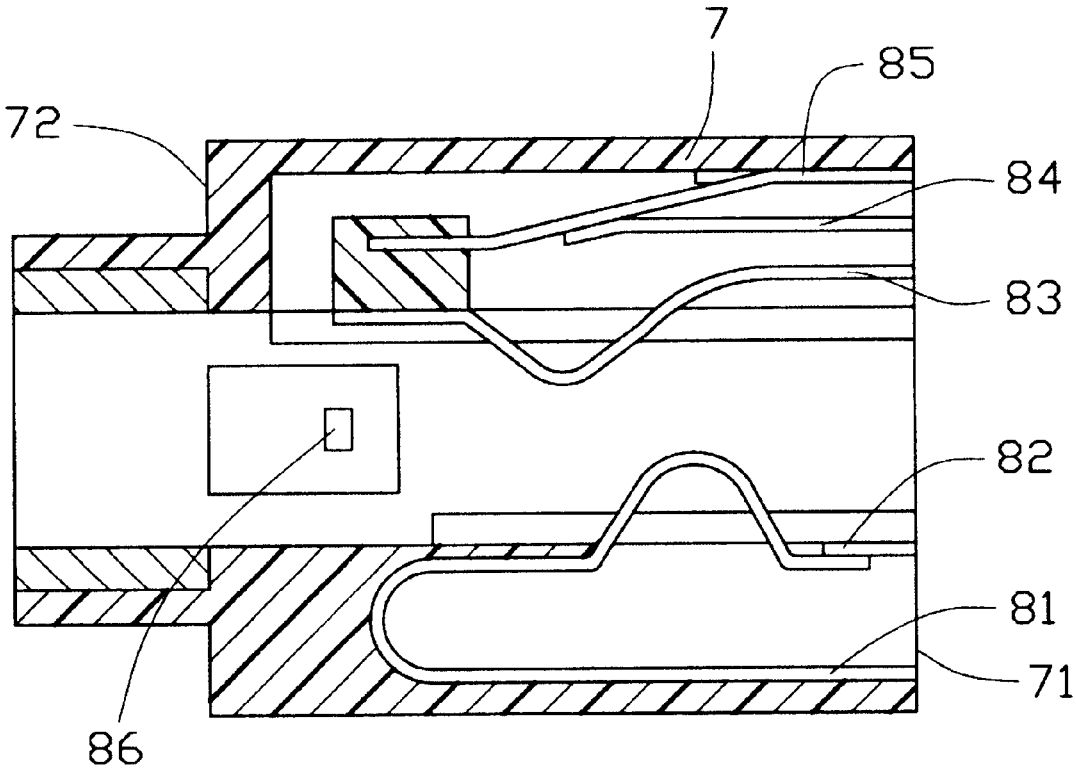
FIG. 5 (PRIOR ART)
FIG. 5 is a cross-sectional view of a conventional audio jack connector.

Further referring to FIGS. 3 and 4, all the terminals 1, 2, 3, 4 and 5 are made of conductive material. The first fixing terminal 1 is L-shaped and comprises a contacting portion 11, a widened fixing portion 13 extending from one end of the contacting portion 11, and a solder portion 12 perpendicularly extending from the fixing portion 13. The fixing portion 13 is retained in the first slit 604 and the contacting portion 11 extends into the receiving space 601. The solder portion 12 extends beyond the bottom wall 61 for being soldered on the PCB. The fixing portion 13 forms a bump 131 for securing the first fixing terminal 1 in the first slit 604. The contacting portion 11 also forms a protrusion 111. The first and second resilient terminals 2, 4 are U-shaped and each comprises a resilient contacting portion 21, 41, and a fixing portion 23, 43 with the contacting portion 21, 41 extending from one end of the fixing portions 23, 43, and a solder portion 22, 42 perpendicularly extending from the fixing portion 23, 43 and beyond the opening 6051, 6071. The resilient contacting portions 21, 41 are received in the receiving space 601 and the fixing portions 23, 43 are retained in the second and fourth slits 605, 607, respectively. The fixing terminal 3 also comprises a contacting portion 31 received in the receiving space 601, a fixing portion 33 retained in the third slit 606 and a solder portion 32 extending beyond the bottom wall 61 from the opening 6061. The contacting portion 21 of the first resilient terminal 2 is in electrical contact with the protrusion 111 formed on the contacting portion 11 of the first fixing terminal 1 when the mating plug 7 is not mated with the jack connector. The contacting portion 41 of the second resilient terminal 4 is in electrical contact with the contacting portion 31 of the second fixing terminal 3 when the mating plug 7 is not mated with the jack connector. The grounding terminal 5 comprises a contacting portion 51 extending into the receiving space 601, a fixing portion 53 retained in the fifth slit 608 and a solder portion 52 extending beyond the bottom wall 61. The first fixing terminal 1 has a small dimension relative to a corresponding terminal of the prior art and the integrity of the insulating body 6 is enhanced because the first slit 604 is shorter than that of the prior art.

Referring to FIG. 4, the plug 7 comprises a base 70 and a mating portion 700. The mating portion 700 comprises a head portion 71, a middle portion 72 and a root portion 73. When the plug 7 is inserted into the insulating body 6, the mating portion is inserted into the receiving space 601 of the insulating body 6 from the tubular projection portion 65. The head portion 71 abuts against the contacting portion 41 of the second resilient terminal 4, the middle portion 72 abuts against the contacting portion 21 of the first resilient terminal 2 and the root portion 73 abuts against the contacting portion 51 of the grounding terminal 5. The contacting portion 21 of the first resilient terminal 2 disconnects with the contacting portion 11 of the first fixing terminal 1 and the contacting portion 41 of the second resilient terminal 4 disconnects with the contacting portion 31 of the second fixing terminal 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack connector for receiving a mating plug, comprising:

an insulating body comprising a front wall, a top wall and a bottom wall extending rearwardly from top and bottom edges of the front wall, and a rear face opposite to the front wall, a receiving space being defined through the insulating body from the rear face to the front wall for receiving the mating plug, the bottom wall defining a first slit in communication with the receiving space, the top and bottom walls together defining a plurality of second slits from the rear face toward the front wall; and a first terminal inserted into the first slit from the bottom wall and a plurality of second terminals inserted into the plurality of second slits from the rear face;

a pair of side walls connecting with the top wall, the bottom wall, and the front wall, a slit being defined in a side wall to receive a grounding terminal thereinto;

wherein the first terminal is L-shaped and comprises a contacting portion received into the receiving space, a fixing portion extending from one end of the contacting portion and fixed into the first slit, and a solder portion perpendicularly extending from the fixing portion and beyond the bottom wall;

wherein the first slit is defined in the bottom wall and is adjacent to the front wall;

wherein two of the second terminals are signal terminals and each of the two has a retaining portion received and fixed in corresponding second slits defined from the rear face, each has a resilient contacting portion extending from the respective retaining portion and into the receiving space for electrically connecting with the mating plug, and each has a solder portion extending from the respective retaining portion;

wherein the first terminal is a switch terminal which is in electrical contact with one of the signal terminal; before the mating plug is inserted into the receiving space;

wherein one of the second terminals is a switch terminal and has a retaining portion received in one of the second slits, a contacting portion extending into the receiving space, and a solder portion extending from the retaining portion, and the contacting portion is in electrical contact with one of the signal terminal before the mating plug is inserted into the receiving space.

2. The audio jack connector as described in claim 1, wherein the fixing portion of the first terminal forms a bump for securing the first terminal in the first slit.

3. An audio jack connector for receiving a plug, comprising:

an insulating body defining a cavity therein for receiving said plug, a rear face and a bottom face of the housing surrounding said cavity;

a first pair of terminals disposed by one side of and in communication with the cavity, said first pair of terminals constantly engaged with each other around a front portion of the cavity under no plug being received in the cavity;

a second pair of terminals disposed by the other side and in communication with the cavity, said second pair of terminals constantly engaged with each other around a rear portion of the cavity under no plug being received in the cavity;

said housing defining a pair of passageways extending from the rear face into the housing and receiving said second pair of terminals, respectively;

said housing defining at least one passageway extending from the bottom face into the housing and receiving at least one of said first pair of terminals;

wherein said at least one of the first pair of terminals defines a contacting portion which is not deflected when engaged with the other one of said first pair of terminals.

* * * * *